US011980990B2

(12) United States Patent
Matena et al.

(10) Patent No.: US 11,980,990 B2
(45) Date of Patent: May 14, 2024

(54) METHOD FOR MACHINING A WORKPIECE IN THE PRODUCTION OF AN OPTICAL ELEMENT

(71) Applicant: Carl Zeiss SMT GmbH, Oberkochen (DE)

(72) Inventors: Manfred Matena, Essen (DE); Franz-Josef Stickel, Aalen-Unterrombach (DE); Marc Saitner, Oberkochen (DE); Robert Fichtl, Aalen (DE); Hans-Peter Brust, Essingen-Lauterburg (DE)

(73) Assignee: Carl Zeiss SMT GmbH, Oberkochen (DE)

( * ) Notice: Subject to any disclaimer, the term of this patent is extended or adjusted under 35 U.S.C. 154(b) by 1069 days.

(21) Appl. No.: 16/810,189

(22) Filed: Mar. 5, 2020

(65) Prior Publication Data

US 2020/0198086 A1 Jun. 25, 2020

Related U.S. Application Data

(63) Continuation of application No. PCT/EP2018/071240, filed on Aug. 6, 2018.

(30) Foreign Application Priority Data

Sep. 12, 2017 (DE) ..... 102017216033.0

(51) Int. Cl.

| | |
|---|---|
| ***B24B 13/01*** | (2006.01) |
| ***B24B 37/26*** | (2012.01) |
| ***B24D 13/14*** | (2006.01) |

(52) U.S. Cl.
CPC ..... *B24B 13/01* (2013.01); *B24B 37/26* (2013.01); *B24D 13/147* (2013.01); *B24D 2203/00* (2013.01)

(58) Field of Classification Search
CPC ..... B24B 37/20; B24B 37/22; B24B 37/26; B24B 37/005; B24B 37/04; B24B 37/042; B24B 37/10; B24B 37/107
See application file for complete search history.

(56) References Cited

U.S. PATENT DOCUMENTS 4,128,968 A * 12/1978 Jones ..... G05B 19/4103 451/158
5,287,662 A * 2/1994 Weis ..... B24D 7/18 451/538

(Continued)

FOREIGN PATENT DOCUMENTS

DE 102011084118 A1 4/2013
DE 102017202649 A1 4/2014

(Continued)

OTHER PUBLICATIONS

Japanese Office Action, with translation thereof, corresponding to JP Appl No. 2020-514729, dated Feb. 15, 2022.

(Continued)

*Primary Examiner* — Joel D Crandall
(74) *Attorney, Agent, or Firm* — Fish & Richardson P.C.

(57) ABSTRACT

A method for the zonal polishing of a workpiece includes using a polishing tool to guide a structured polishing pad over the surface of workpiece to remove material from the workpiece. A structured polishing pad includes a structuring adapted to the movement of a polishing tool.

15 Claims, 11 Drawing Sheets

(56) References Cited

U.S. PATENT DOCUMENTS

| | | | | |
|---|---|---|---|---|
| 6,120,366 | A | 9/2000 | Lin et al. | |
| 6,159,088 | A | 12/2000 | Nakajima | |
| 6,361,647 | B1 * | 3/2002 | Halley | B24B 49/006 156/345.1 |
| 6,602,121 | B1 * | 8/2003 | Halley | B24B 37/30 483/33 |
| 6,749,714 | B1 | 6/2004 | Ishikawa et al. | |
| 6,837,780 | B1 * | 1/2005 | Broido | B24B 37/16 451/527 |
| 7,329,174 | B2 * | 2/2008 | Hosaka | B24D 18/0009 451/526 |
| 8,734,206 | B2 * | 5/2014 | Chang | B24B 41/06 451/286 |
| 2002/0058469 | A1 | 5/2002 | Pinheiro et al. | |
| 2003/0032378 | A1 | 2/2003 | Ichimura et al. | |
| 2004/0043710 | A1 | 3/2004 | Miyazaawa | |
| 2008/0211141 | A1 * | 9/2008 | Deopura | B24D 18/0009 264/331.19 |
| 2009/0104849 | A1 * | 4/2009 | Wang | B24B 37/26 451/36 |
| 2009/0311955 | A1 * | 12/2009 | Kerprich | B24B 37/26 451/527 |
| 2017/0274496 | A1 * | 9/2017 | Cook | B24B 37/26 |
| 2018/0071881 | A1 | 3/2018 | Horie et al. | |

FOREIGN PATENT DOCUMENTS

| | | | |
|---|---|---|---|
| EP | 1211023 | A1 | 6/2005 |
| JP | 2001-38592 | A | 2/2001 |
| JP | 2003-53657 | A | 2/2003 |
| JP | 2006-156876 | A | 6/2006 |
| WO | WO 2006/072452 | A1 | 7/2006 |
| WO | WO 2013/102206 | A1 | 7/2013 |
| WO | WO 2016/199612 | | 12/2016 |

OTHER PUBLICATIONS

German Office Action, with translation thereof, corresponding to DE Application No. 10 2017 216 033.0, dated Jul. 19, 2018.

Translation of International Search Report for corresponding PCT Appl No. PCT/EP2018/071240, dated Nov. 9, 2018.

Japanese Office Action, with translation, for corresponding JP Appl No. 2020-514729, dated Jan. 24, 2023.

Japanese Office Action, with translation of summary, for corresponding JP Appl No. 2020-514729, dated Mar. 8, 2022.

* cited by examiner

METHOD FOR MACHINING A WORKPIECE IN THE PRODUCTION OF AN OPTICAL ELEMENT

FIELD

The present disclosure relates to a method for machining a workpiece in the production of an optical element, in particular for microlithography. The disclosure additionally relates to structured polishing pads for polishing a workpiece.

BACKGROUND

Microlithography is used for producing microstructured components such as, for example, integrated circuits or LCDs. The microlithography process is conducted in what is called a projection exposure apparatus, which includes an illumination device and a projection lens. The image of a mask (=reticle) illuminated via the illumination device is in this case projected via the projection lens onto a substrate (for example a silicon wafer) coated with a light-sensitive layer (photoresist) and arranged in the image plane of the projection lens, in order to transfer the mask structure to the light-sensitive coating of the substrate.

In projection lenses designed for the DUV range, i.e. at wavelengths of e.g. 193 nm or 248 nm, lens elements are preferably used as optical elements for the imaging process.

In projection lenses designed for the EUV range, i.e. at wavelengths of e.g. approximately 13 nm or 7 nm, owing to the lack of availability of suitable light-transmissive refractive materials, mirrors are used as optical elements for the imaging process.

In view of the transmission losses that occur on account of the limited reflectivities of the individual mirror surfaces in such systems, in principle it is desirable to minimize the number of mirrors used in the respective optical system. In practice this results in demanding challenges in terms of production engineering, the challenges including not only the enlargement of the mirror surfaces that accompanies approaches for increasing the numerical aperture but also the production of freeform surfaces without rotational symmetry.

In the production of an optical element, such as lens elements or mirrors, after shaping via grinding processes, the geometry of the surface of the optical element is a decisive factor regarding the subsequent machining methods.

If the geometry of the surface of the workpiece involves for example planar surfaces, spheres or any other surfaces whose deviation from the surfaces just mentioned is small, it is possible to use areal machining methods (e.g. synchro-SPEED or lever polishing) for polishing. In this context, areal machining methods denote methods in which the size of the tool approximately corresponds to the size of the workpiece or in which the tool is significantly larger than the workpiece. By contrast, if the surfaces involved are surfaces which deviate greatly from the surfaces mentioned above, that is to say are the "freeform surfaces" mentioned above, so-called "zonal methods" have to be used in the method steps succeeding the grinding. In the case of zonal methods, the tool is significantly smaller than the workpiece.

In zonal machining, the material removal is realized via periodic movements of the tool. In this case, the tool can rotate about its center (rotary tool). Alternatively, with fixed orientation or alignment with respect to the surface of the workpiece, the tool can be rotated about a rotation axis acting outside its center (eccentric tool). The removal rate can be varied for example by varying the pressure of the tool on the surface of the workpiece, and by varying the rotational speed of the tool.

After shaping via grinding processes, use is made of the abovementioned methods for producing the fully polished surface. In this case, the so-called "depth damage" left behind by the grinding processes is eliminated, with the result that the fully polished surface of the workpiece has a polishing level of p3 or better (DIN-ISO 10110) and the surface of the optical element is thus shiny. In addition, minimized "fine structures" of the fully polished surface reduce outlays in subsequent machining processes.

In this case, "depth damage" is understood to mean cracks which are present after the grinding process and give the surface of the machined workpiece a rough appearance and typically extend into the material over a depth of 20 μm to 100 μm. The width of such depth damage can be of the order of magnitude of e.g. 10 μm. The elimination of the depth damage is carried out by way of material-removing machining and takes place in the polishing process.

By contrast, "fine structures" are understood in this document to mean structures which, with a lateral extent of 1 mm to 5 mm, for example, and a depth of 10 nm to 30 nm, for example, are not directly visually perceptible or perceptible with the naked eye and do not adversely affect a specularly reflective appearance of the surface of the workpiece, but are detectable by interferometry.

When reducing fine structures, what plays an important part, besides the constitution and stiffness of the polishing pad, is the size of the tool, for example. The greater the extent of the tool in comparison with the lateral extent of the fine structures, the more efficiently fine structures can be reduced. However, increasing the size of the tool can hamper a stable and uniform supply of polishing agent between tool surface and workpiece surface and hence "good lubrication". In addition, the tool itself can produce fine structures on account of its movement and the structure of the polishing pad.

In order to eliminate fine structures in freeform surfaces via zonal machining methods, a high outlay is needed.

In order to be able to image even smaller structures with the coming generation of lithographic lenses for EUVL, optical elements having high deformations (PV of the deviation of the best-fit sphere >100 μm) are used. At the same time, the optical surfaces of the coming generation of lithographic lenses for EUVL are significantly larger.

In the coming generation of lithographic lenses for EUVL, after the grinding processes and the zonal lapping process optionally following the latter, a zonal polishing is used for producing the so-called fully polished surface. Areal methods cannot be used in this case.

During full polishing, depending on the initial state of the ground or lapped surface, removals of approximately 10 μm to approximately 30 μm are used in order to eliminate the depth damage. Limiting the machining times as the optical surfaces become larger involves zonal polishing processes with removal rates of >1 $mm^3$/min in the case of tool extents in the range of between approximately 20 mm and 40 mm. At the same time, the process desirably ensures constant removal rates. This can be achieved, inter alia, via a stable supply of polishing agent between tool surface and workpiece surface and via "good lubrication" associated therewith.

The high removal rates have been achieved hitherto by increasing the pressure and rotational speed of the tool. Depending on the polishing pad used, however, increasing the pressure and rotational speed results in significant variations of the removal rate during the machining period. This restricts the use time of the tool and thus increases the number of tool changes during the machining period.

This gives rise to further restrictions during machining: if the intention is not to carry out a tool change during partial machining, i.e. during a pass in which the entire optical surface of the workpiece is swept over once by the tool, decreasing use time involves increasing parameters such as the path distance and/or the feed rate. Increasing the path distance also increases the distance between path traces. Increasing the feed rate increases the distance between "feed traces" that arise on account of the periodic movement of the tool, since, as the feed rate is increased, the distance covered by the tool after a revolution also increases. In both cases, the changed parameters result in an increase in the lateral extent of the undesired fine structures. This hampers the reduction of the fine structures in subsequent machining processes.

SUMMARY

The disclosure seeks to provide a method which allows a removal rate that is as constant as possible over a time period that is as long as possible. The disclosure also seeks to provide polishing pads for the tools which allow a constant removal rate and, at the same time, impress into the optical surface of the workpiece as few of their "own fine structures" as possible, which would have to be removed again in subsequent machining processes.

According to the disclosure, a method for the zonal polishing of a workpiece is provided, wherein a polishing tool guides a structured polishing pad, the structuring of which is adapted to the movement of the polishing tool in a material-removing manner over a surface to be polished of the workpiece. The structure of the polishing pad that is adapted to the movement of the tool is intended to enable a stable supply of polishing agent between tool surface and workpiece surface and "good lubrication" associated therewith.

In one embodiment, a "rotary tool" as polishing tool guides the structured polishing pad in a rotating movement over the surface to be polished of the workpiece. The absolute values of the relative velocities between tool and workpiece increase proportionally to the distance from the center of the tool. A primary and secondary structuring according to the disclosure makes it possible to achieve a constant removal rate in comparison with the non-structured polishing pad during the use time of the tool. The various variants and the advantages of the associated structuring of the polishing pad will be described later.

In one embodiment, an "eccentric tool" as polishing tool guides the structured polishing pad in an eccentric movement over the surface to be polished of the workpiece. The polishing pad experiences no inherent rotation in this case. As a result, the absolute values of the relative velocities between tool and workpiece at all points below the tool are identical. The effective tool area, that is to say the area on which material is removed, when the tool is not guided over the workpiece, is composed of the size of the eccentric and the size of the polishing pad. The size and the rotational speed of the eccentric yield the relative velocity. In the case of the eccentric tool, a simple checkered pattern on the polishing pad is sufficient to ensure a constant removal rate during the use time of the tool in comparison with the non-structured polishing pad. Even this simple structure improves the lubrication between tool and workpiece. At the same time, the uniform checkered pattern is blurred by the eccentric movement and the production of fine structures by the polishing pad itself is thus minimized.

In the case of the eccentric tool, the effective tool area is larger than the area of the polishing pad, while both areas are equal in size in the case of the rotary tool. As a result—for the same area of the polishing pad—eccentric tools involve a larger polishing excursion than rotary tools. Here the polishing excursion denotes an additional area which encloses virtually in a ring-shape manner the optical area that is actually to be machined. The (zonal) tool has to "sweep over" this additional area besides the optical area that is actually to be processed, in order that complete coverage is ensured on the latter.

According to the disclosure, a method for producing an optical element, in particular for microlithography, is provided, wherein the method includes the following successive method steps. Providing a workpiece is followed by grinding a surface of the workpiece. This is then optionally followed by the zonal lapping of the surface. This is then followed by the zonal polishing of the surface in accordance with the rotary and/or eccentric method described above. This is subsequently followed by correcting and smoothing the surface.

In one embodiment, the zonal lapping and/or the zonal polishing of the surface of the workpiece are/is carried out with a tool whose effective area is less than 20%, preferably less than 10%, of the surface to be machined of the workpiece.

The disclosure is also based on the concept, during the machining of freeform surfaces, of achieving efficient elimination of depth damage and fine structures by so-called zonal lapping machining being combined with zonal polishing machining in a two-stage process. The circumstance that, in this two-stage process following the grinding machining of the workpiece, firstly lapping machining is additionally carried out before polishing machining can result in a significant speed advantage since the lapping machining has a significantly higher removal rate (e.g. by an order of magnitude) in comparison with a pure polishing process.

In this case, the disclosure deliberately accepts the fact that during the reduction of the depth damage present after the grinding process, the reduction generally being only partial but in return comparatively rapid, depth damage is reintroduced during the lapping process as well.

However, the depth damage present overall after the lapping process (i.e. both the depth damage only partially eliminated during the lapping process and the depth damage newly added, as described above) is then removed in the subsequent second process state, (i.e. the zonal polishing machining). As a result, the fully polished surface freed of the undesired structures mentioned above can thus be produced with considerably reduced time expenditure.

Even though the disclosure is advantageously usable in particular in the machining of freeform surfaces, the disclosure is not restricted thereto. In this regard, in further embodiments, the method according to the disclosure can be applied to the machining of arbitrary workpiece geometries.

Furthermore, the disclosure is not restricted for instance to the machining of a mirror substrate as workpiece, but rather is also usable in the production of arbitrary optical elements (including transmissive elements such as lens elements).

According to the disclosure, a polishing pad for the zonal polishing of a surface of a workpiece is provided, wherein the polishing pad has at least one structure adapted to the movement of the tool. The structuring of the polishing pad is targeted at a uniform distribution of the polishing agent below the polishing pad in comparison with the polishing pad without a structure. A comparatively constant removal rate can thus be achieved.

Embodiments provide a polishing pad wherein, wherein, when a rotary tool is used as polishing tool, a primary structuring of the polishing pad has a spiral shape having a plurality of spiral arms. The spiral shape is intended to make possible, during the rotary movement, the transport of the polishing agent from the edge to the center and thus a more uniform distribution of the polishing agent below the polishing pad in comparison with the unstructured polishing pad. In order to achieve a certain asymmetry of the structuring, which can be advantageous with regard to avoiding undesired fine structures caused by the tool itself, the spiral arms can have mutually deviating opening angles.

Embodiments provide a polishing pad having a secondary structuring besides the primary structuring mentioned above. The secondary structuring has symmetrical, in particular rotationally symmetrical, channels. The channels are arranged e.g. concentrically around the center of rotation and are targeted in particular at a more uniform polishing agent distribution between the primary structures. A constant removal rate in comparison with the unstructured pad and with the pad having a primary structure is thus possible. As a result of the symmetrical secondary structure in combination with the rotary movement of the tool, undesired fine structures can, however, be introduced into the optical surface.

Embodiments provide a polishing pad whose secondary structuring has asymmetrically arranged channels. The irregularity results in the minimization of the structures introduced by the rotary tool itself "Chaotic" channels are intended to ensure that the fewest possible structures from the polishing pad are transferred to the surface to be polished of the workpiece.

Embodiments provide a polishing pad for use with an eccentric tool as a polishing tool, wherein the structuring of the polishing pad is regular and/or symmetrical. This cooperation of the eccentric movement of the polishing pad and the symmetrical structuring of the polishing pad is particularly advantageous since a uniform removal rate is achieved during zonal polishing, without appreciable fine structures being introduced into the surface of the workpiece on account of the structure itself.

For use with an eccentric tool, in one embodiment, the regular and/or symmetrical structuring of the polishing pad is realized as a checkered pattern. The checkered pattern can be produced particularly simply and has the advantages mentioned above.

In one embodiment, the regular and/or symmetrical structuring has channels and ridges. The channels desirably are not be too shallow, in order that a stable supply of polishing agent can be made possible even during the polishing process, in which the pad is compressed and the depth of the channels decreases as a result of wear of the pad. Advantageously, therefore, the depth of the channels is at least approximately 100 μm and preferably approximately 500 μm.

A multiplicity of substances are suitable as material for the polishing pads, such as e.g. polyurethane and woven or nonwoven, binder-bonded synthetic fibers, for example polyester fibers. Simple structures can be stamped or cut into the polishing pads. Complex structures in the polishing pads, which are advantageous/desirable for rotary tools, for example, can be produced by structuring tools, such as e.g. by lasers.

According to the disclosure, an optical element including a workpiece is provided, the workpiece surface of which was machined by grinding, optional zonal lapping and zonal polishing. The optical element can be embodied as a light-transmitting lens element. The optical element can likewise be embodied as a light-reflecting mirror consisting of a workpiece machined according to the method mentioned above and a reflection layer system arranged on the surface of the workpiece and configured to reflect EUV radiation. The optical element can likewise be embodied as a light-reflecting mirror configured to reflect UV light, in particular light having a wavelength of approximately 193 nm or approximately 248 nm.

According to the disclosure, a microlithographic projection exposure apparatus is provided which includes an illumination device and a projection lens, wherein the projection exposure apparatus includes at least one optical element having the properties mentioned above.

According to the disclosure, a zonal polishing method is provided, wherein the removal rate over time is approximately constant. This is advantageous since the polishing pad then remains usable for a comparatively long time.

BRIEF DESCRIPTION OF THE FIGURES

Various exemplary embodiments are explained in more detail below with reference to the figures. The figures and the relative sizes of the elements illustrated in the figures in relation to one another should not be regarded as to scale. Rather, individual elements may be illustrated with exaggerated size or size reduction in order to enable better illustration and for the sake of better understanding.

DESCRIPTION OF EXEMPLARY EMBODIMENTS

Figure 1A:
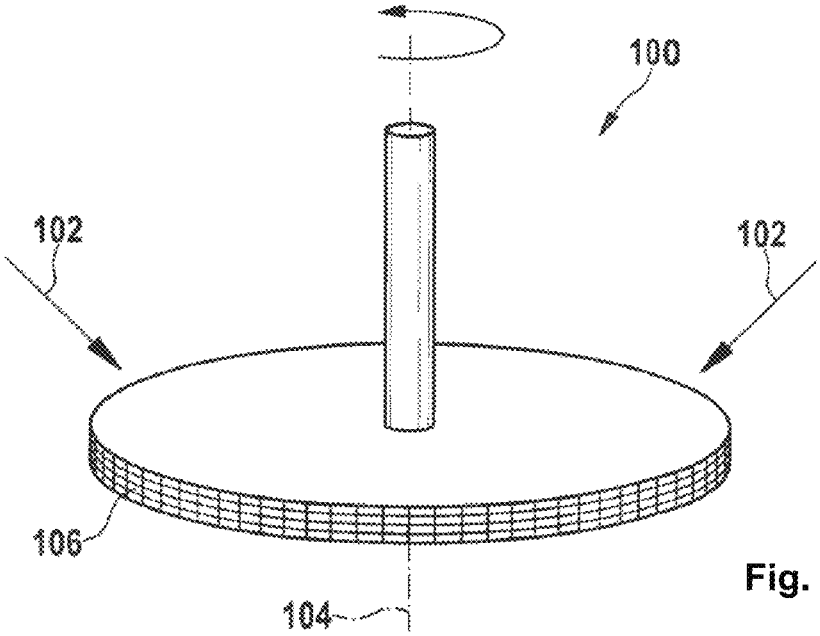
FIG. 1A shows a schematic illustration of a rotary tool.
Figure 1B:
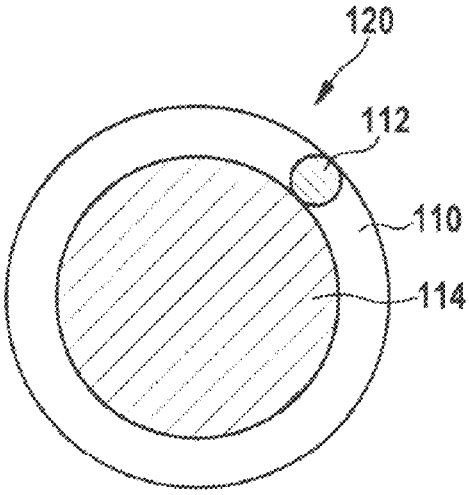
FIG. 1B shows a schematic illustration of the zonal machining according to the disclosure with the use of a rotary tool.

FIGS. 1A-1B show a schematic illustration of a rotary tool 100. The tool carrier 106, which carries a polishing pad (not shown in FIG. 1A), rotates about the rotation axis 104. A polishing agent is guided onto the surface to be polished via a polishing agent supply 102 consisting of tubes fixed outside the tool.

FIG. 1B shows a schematic illustration 120 of the zonal machining according to the disclosure with the use of a rotary tool. The polishing machining according to the disclosure is carried out as "zonal" workpiece machinings. Here in each case the size of the tool is significantly smaller than the size of the workpiece, wherein the area of the tool can typically occupy less than 10% of the surface 114 to be polished of the workpiece 140. For complete coverage of the zonally machined surface 114 of the workpiece 140 an excursion section 110 is used, which is additionally used by the rotary tool 100 and the area of which has to be swept over by the rotary tool 100 in addition to the surface 114 that is actually to be polished. The effective area 112 of the rotary tool 100, that is to say the area on which material is removed, when the tool is not guided over the workpiece, is illustrated schematically in FIG. 1B. The shape of the polishing pad is illustrated as circular in the present case, but can also have other shapes, such as, for example, a rectangular, square or irregular shape.

Figure 1C:
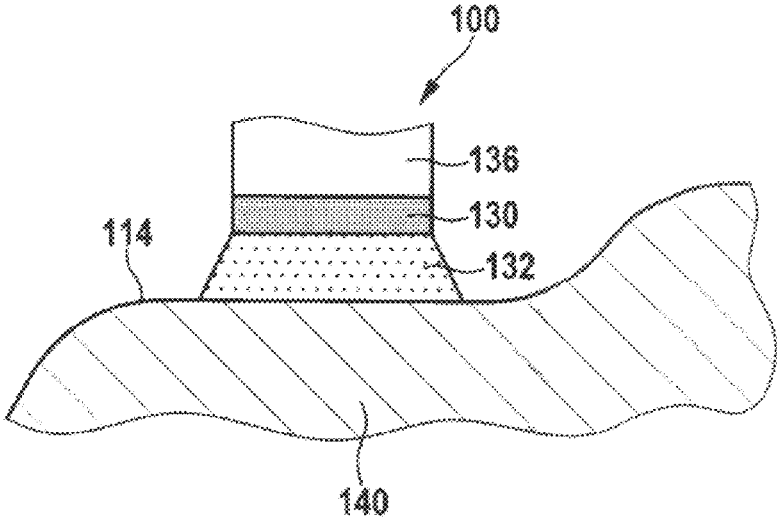
FIG. 1C shows a schematic illustration of a rotary tool in operation.

FIG. 1C shows a schematic illustration of a rotary tool 100 in operation. The surface 114 to be polished of the workpiece 140 is embodied as a freeform surface. A tool carrier 136 carries a polishing pad 130. A polishing agent 132 is situated between the surface 114 to be polished and the polishing pad 130. The view in FIG. 1C is applicable to all the zonal tools shown in the present patent application.

Figure 2A:
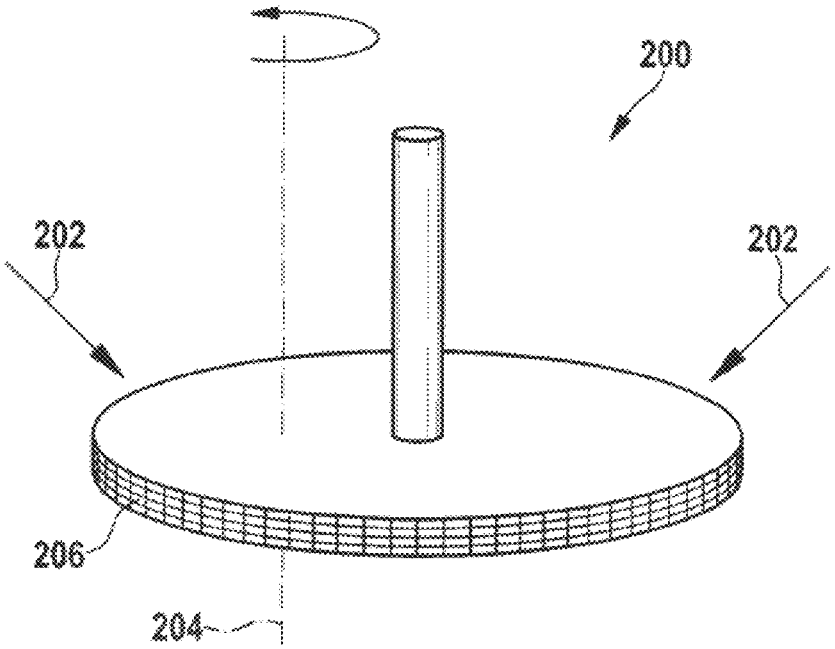
FIG. 2A shows a schematic illustration of an eccentric tool.

FIG. 2A shows a schematic illustration of an eccentric tool 200. In the case of the eccentric movement, the tool maintains its orientation or its alignment with respect to the workpiece surface. The tool carrier 206 moves about the rotation axis 204. The polishing agent is guided onto the surface to be polished via a polishing agent supply 202 consisting of tubes fixed outside the tool.

Figure 2B:
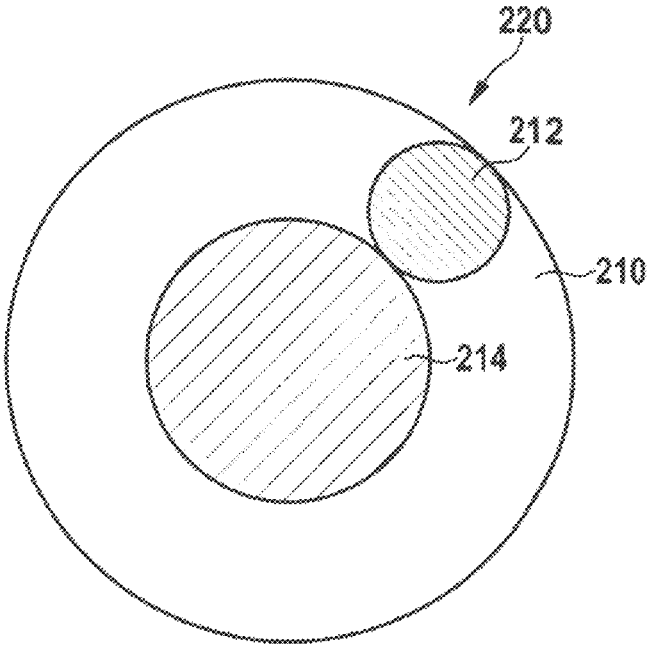
FIG. 2B shows a schematic illustration of the zonal machining according to the disclosure with the use of an eccentric tool.

FIG. 2B shows a schematic illustration 220 of the zonal machining according to the disclosure with the use of an eccentric tool 200. Here in each case the size of the tool is significantly smaller than the size of the workpiece, wherein the area of the tool can typically occupy less than 10% of the surface 214 to be polished of the workpiece 140. For complete coverage of the zonally machined surface 214 of the workpiece 140 an excursion section 210 is used, which is additionally used by the eccentric tool 200 and the area of which has to be swept over by the eccentric tool 200 in addition to the surface 214 that is actually to be polished. Owing to the eccentric movement—for the same area of the polishing pad—a larger excursion section 210 is used in the case of the eccentric tool 200 than in the case of the rotary tool 100. The effective area 212 of the eccentric tool 200, or area on which material is removed, when the tool is not guided over the workpiece, is illustrated schematically in FIG. 2B. The graphical illustration of the eccentric tool in operation corresponds to the illustration of the rotary tool in operation as shown in FIG. 1C. A separate illustration has therefore been dispensed with.

Figure 3A:
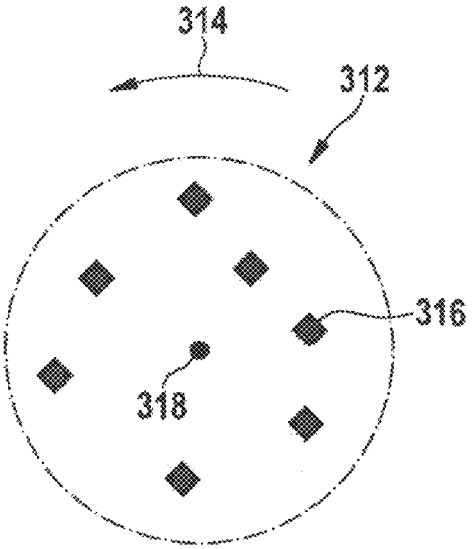
Fig. 3A Prior Art
FIG. 3A shows a polishing pad without structuring from the prior art.

FIG. 3A shows a polishing pad 312 without structuring from the prior art. The rotary tool 100, the polishing pad 312 of which is not structured, has a removal rate that varies significantly during machining (see FIG. 3D), and also dried-on polishing agent residues 316 that are visible on the polishing pad 312 after machining. These effects, which are attributed to an inadequate supply of polishing agent to the center of the tool, which is caused by the rapid rotation of the rotary tool 100 about the rotation axis 318 can be reduced via a suitable structuring of the polishing pad.

Figure 3B:
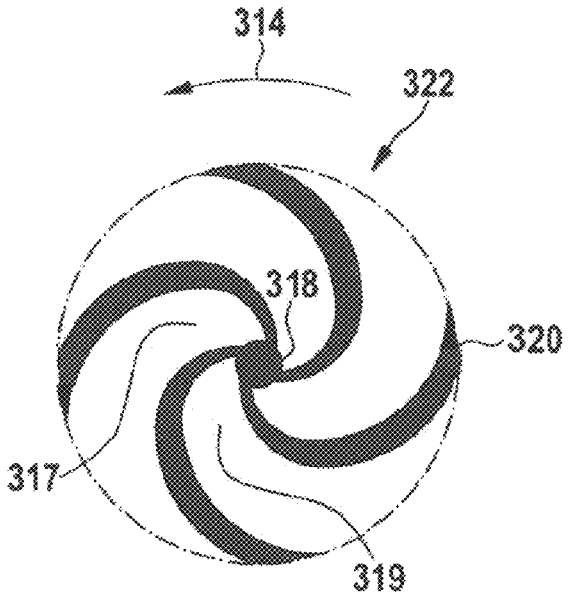
FIG. 3B shows a polishing pad with structuring according to the disclosure.

FIG. 3B shows a polishing pad 322 having a structuring according to the disclosure in a spiral shape 320. The spiral here is designed such that during the rotary movement in the direction of rotation 314 (=in the counterclockwise direction) of the rotary tool 100, the polishing agent 132 is "forced" into the center 318 of the polishing pad 322. Drying-on of the polishing agent 132 can be reduced as a result. The opening angles 317, 319 of the spiral arms deviate from one another in order to produce a certain asymmetry. The asymmetry is intended to reduce the fine structures introduced by the polishing pad 322 itself on the polished surface 114, 214 of the workpiece 140.

Figure 3C:
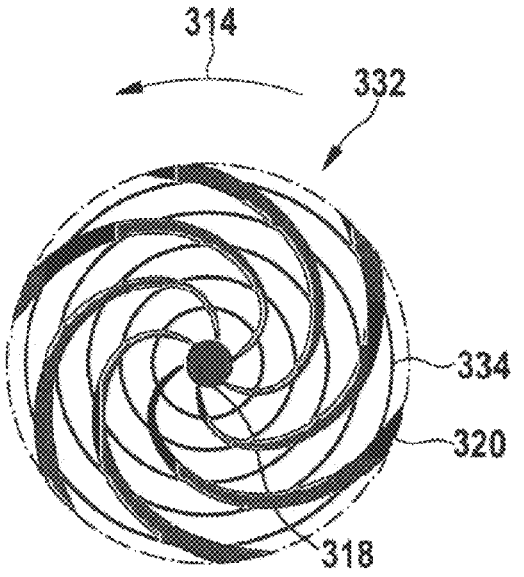
FIG. 3C shows a polishing pad with primary and secondary structuring according to the disclosure.

FIG. 3*c* shows a polishing pad 332 having a primary structuring in a spiral shape 320 and a secondary structuring in the form of rotationally symmetrical (about the rotation axis 318) channels 334. The channels 334 are intended to result in an improved supply of polishing agent between the spiral arms 320.

Figure 3D:
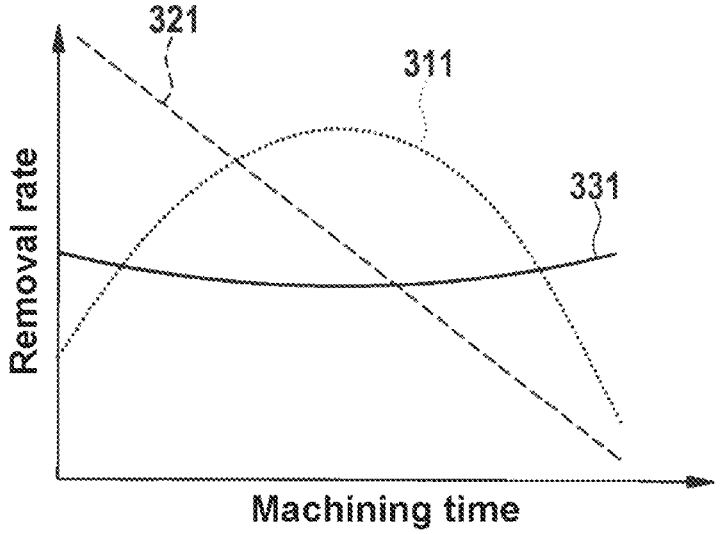
FIG. 3D shows the removal rates for the polishing pads in accordance with FIGS. 3A, 3B and 3C.
Figure 4:
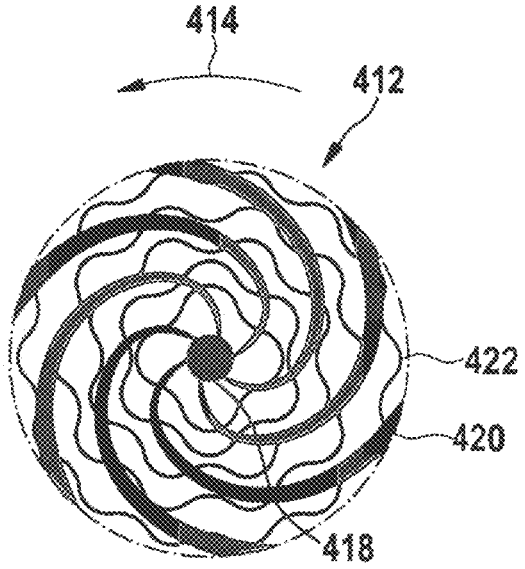
FIG. 4 shows a polishing pad with primary and secondary structuring according to the disclosure.

FIG. 3*d* shows the removal rates for rotary tools 100 having polishing pads in accordance with FIGS. 3A, 3B and 3C. The removal rate 311 with the use of a rotary tool 100 having a polishing pad without structuring 312 varies greatly. The removal rate 321 with the use of a rotary tool 100 having a polishing pad having a structuring in a spiral shape 320 still varies greatly. The removal rate 331 over time with the use of a rotary tool 100 having a polishing pad 332 having a primary structuring in a spiral shape 320 and a secondary structuring in the form of rotationally symmetrical channels 334 is substantially constant. However, an undesired fine structure can be introduced by the rotationally symmetrical channels 334, and it would have to be removed again in subsequent steps. In order to avoid this "detour", the disclosure proposes, as illustrated schematically in FIG. 4, using a polishing pad 412 having a primary structuring in a spiral shape 420 and a secondary structuring in the form of asymmetrically arranged channels 422. The avoidance of periodicities and symmetries in the structuring of the polishing pad 412 serves to minimize the fine structure caused by the rotary tool 100 itself. Expressed in yet another way: "chaotically" arranged channels are intended to minimize the formation of fine structures that are transferred from the polishing pad 412 to the surface 114, 214 of the workpiece 140.

Figure 5A:
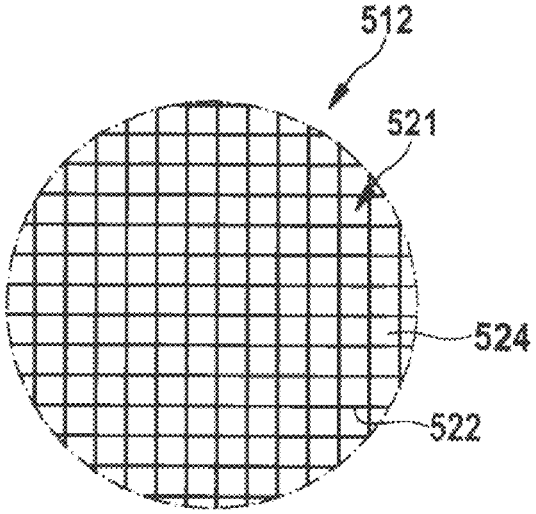
FIG. 5A shows a polishing pad with structuring according to the disclosure.

FIG. 5A shows a polishing pad 512 having a regular and symmetrical structuring 521 according to the disclosure for an eccentric tool 200. The structuring 521 has channels 522 and ridges 524. A checkered pattern is shown in the present example. The shape of the polishing pad 512 is illustrated as circular in the present case, but can also have other shapes, such as, for example, a rectangular, square or irregular shape.

Figure 5B:
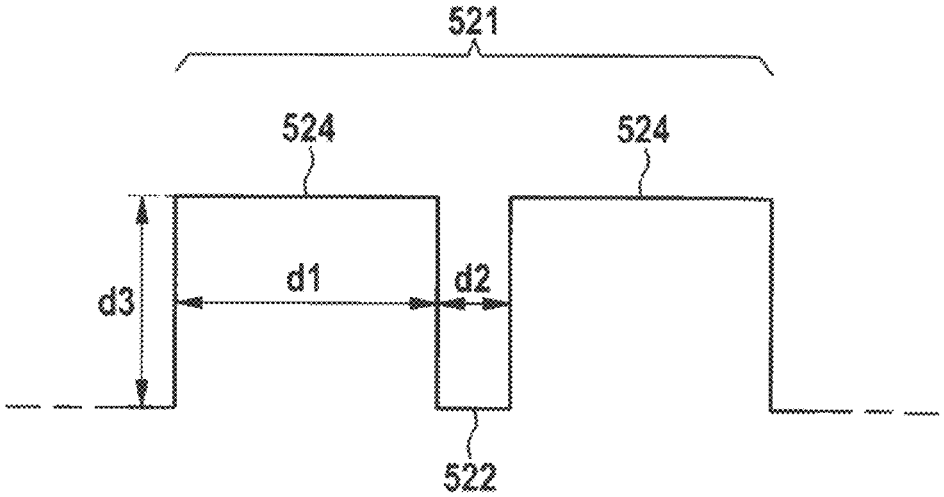
FIG. 5B shows the detailed structure in the case of the polishing pad from FIG. 5A.

FIG. 5B shows the detailed structure 521 for the polishing pad 512 from FIG. 5A. The ridges 524 have a width d1 of approximately 1 mm to approximately 5 mm, the channels 522 have a width d2 of approximately 0.3 mm to approximately 1 mm and a depth d3 of at least approximately 100 μm and preferably approximately 500 μm. This is intended to ensure that the polishing agent 132 remains distributed uniformly below the polishing pad 512 during the polishing process.

Figure 5C:
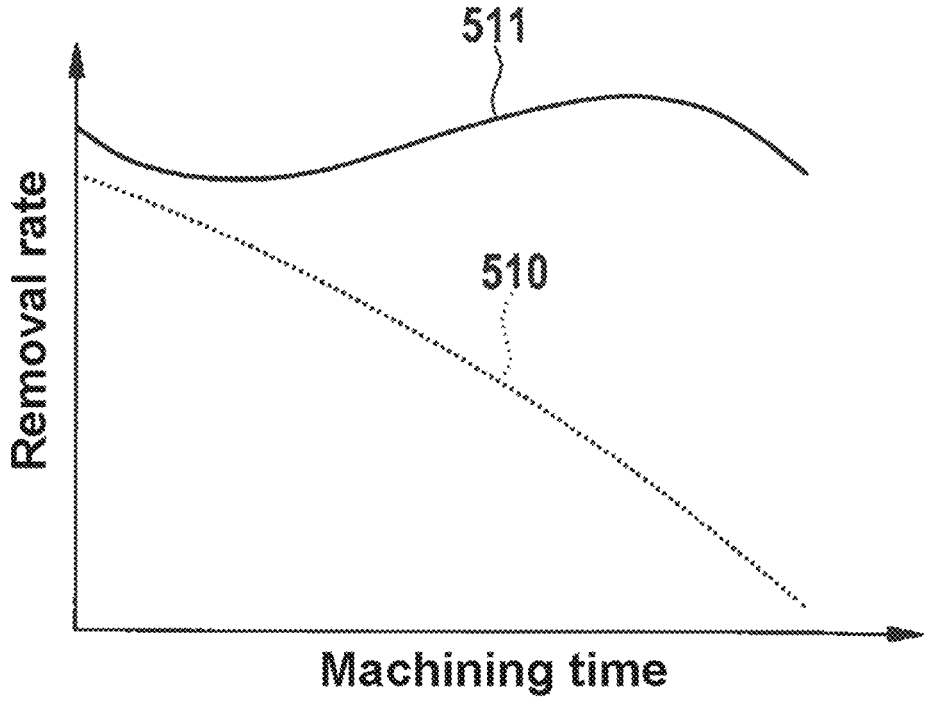
FIG. 5C shows the removal rate for the polishing pad from FIG. 5A in comparison with a polishing pad without structuring.

FIG. 5C shows the removal rate 511 for an eccentric tool 200 having the polishing pad 512 from FIG. 5A in comparison with the removal rate 510 for an eccentric tool 200 having a polishing pad without structuring 312. The variation of the removal rate 511 with the use of an eccentric tool having a polishing pad having a regular and symmetrical structuring (checkered pattern) 512 is significantly reduced. The eccentric tool 200 having the polishing pad 512 according to the disclosure can be in operation for longer in comparison with the polishing pad without a structuring 312.

Furthermore, a method for machining a workpiece 140 or a (mirror) substrate 140 in the production of an optical element 150 is explained with reference to the flow diagram illustrated in FIG. 6.

Figure 6:
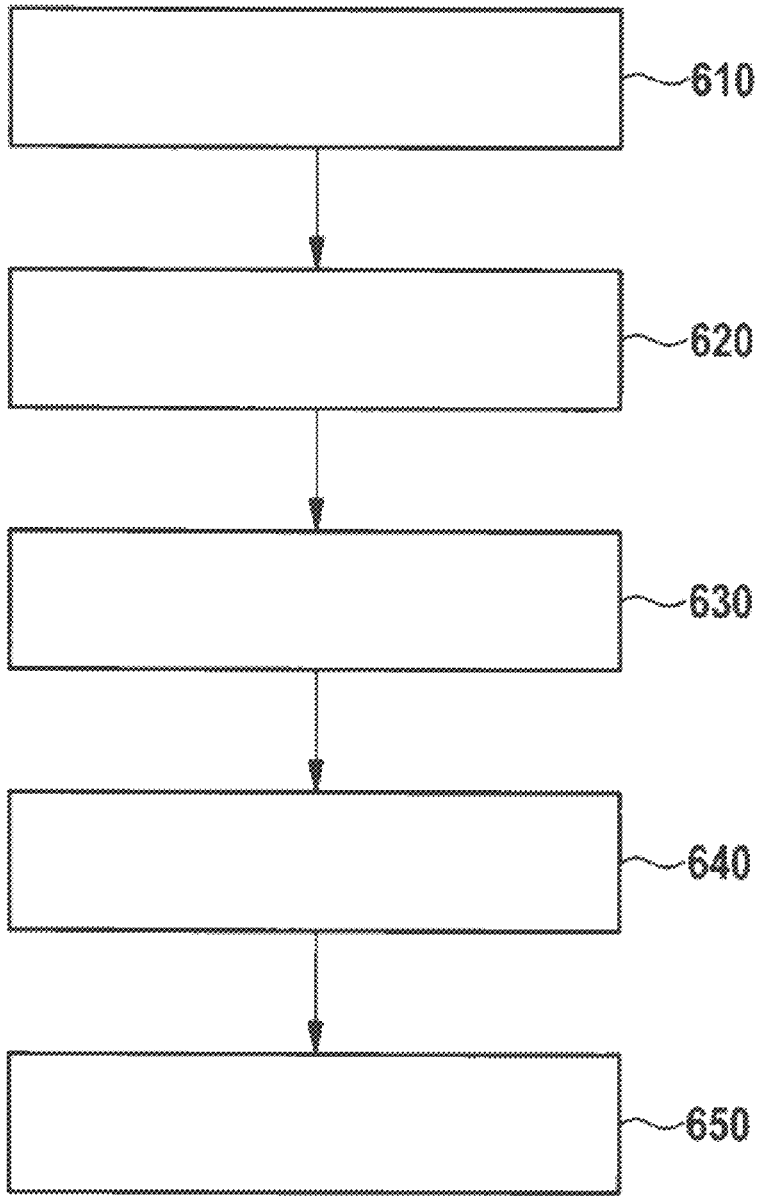
FIG. 6 shows a flow diagram for elucidating one possible embodiment of the method according to the disclosure.

In accordance with FIG. 6, a first step 610 firstly involves providing a workpiece blank 140 composed of the raw material or (mirror) substrate material. In a subsequent step 620, the workpiece blank 140 is machined for the contouring of the optical element 150 by grinding, for example, the desired contour of the mirror substrate 140 or of the optical element 150 being produced.

Afterward, in order to produce the fully polished surface 114, 214 of the workpiece 140 in a manner according to the disclosure, a two-stage process is carried out, in which optional zonal lapping machining (step 630) is combined with zonal polishing machining (step 640). In this case, firstly the surface 114, 214 of the workpiece 140, which surface can be a freeform surface without rotational symmetry or other axes of symmetry, is zonally machined using a lapping tool. The lapping removal can be 15 μm, for example, wherein the removal rate can be chosen to be greater than in the subsequent polishing step 640 by a factor of ten. This results in a significant speed advantage during the production of the fully polished surface. As a result of the zonal lapping process, the temporary production of additional depth damage is deliberately accepted. If it is assumed in the above example of a lapping removal of 15 μm, for instance, that depth damage having a depth of approximately 30 μm is originally present as a result of the preceding grinding process in the workpiece, then firstly a partial reduction of this depth damage already present to e.g. approximately 15 μm and additionally further depth damage having a depth of likewise approximately 15 μm, for example, arise as the interim result after the zonal lapping process. However, both types of depth damage (i.e. both that already present originally as a result of the grinding process 620 and that added owing to the lapping process 630) can then be eliminated efficiently in the subsequent zonal polishing process 640.

In the zonal polishing 640, a polishing tool 100, 200 guides a structured polishing pad 322, 332, 412, 512, the structuring of which is adapted to the movement of the polishing tool 100, 200 in a material-removing manner over a surface 114, 214 to be polished of the workpiece 140.

In the case of a rotary tool 100 as polishing tool, the structured polishing pad 322, 332, 412 is guided in a rotary movement over the surface 114 to be polished of the workpiece 140.

In the case of an eccentric tool 200 as polishing tool, the structured polishing pad 512 is guided in an eccentric movement over the surface 214 to be polished of the workpiece 140.

Both the optional lapping machining (step 630) and the subsequent polishing machining (step 640) are carried out as "zonal" workpiece machinings. In this case, the size of the tool is significantly smaller than the size of the workpiece, wherein the area of the tool can typically occupy less than 10% of the workpiece surface. Furthermore, as illustrated in FIGS. 1B and 2B, for complete coverage of the zonally machined area of the workpiece, an excursion section 110, 210 is used, which is additionally used and the area of which has to be swept over by the tool 100, 200 in addition to the surface 114, 214 that is actually to be polished.

A final step 650 involves correcting and smoothing the surface 114, 214 of the workpiece 140 or of the optical element 150. The final specification of the optical element 150 is thus produced. Besides polishing processes, the step 650 can, for example, also include ion beam figuring processes (IBF).

Figure 7:
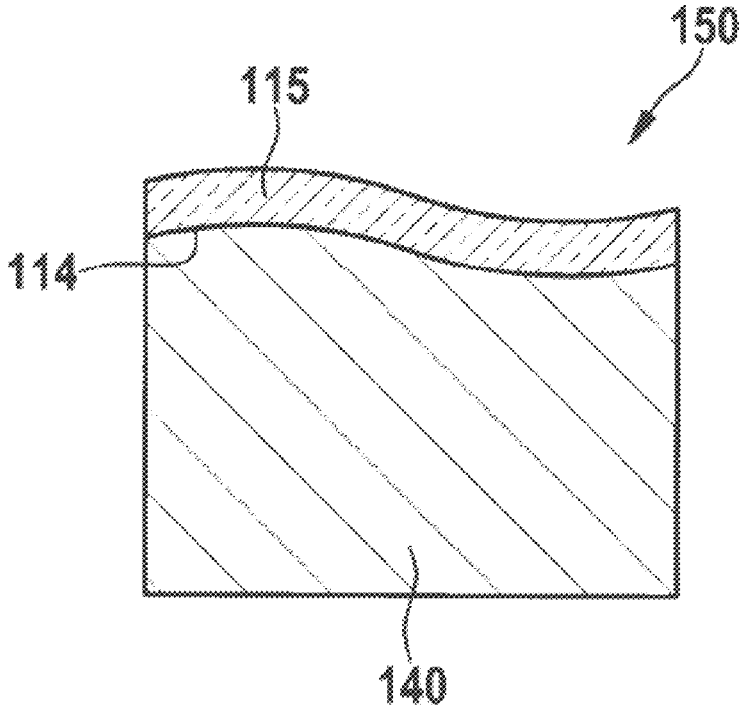
FIG. 7 shows a schematic illustration of an optical element.

FIG. 7 shows a schematic illustration of an optical element 150. The optical element 150 is a mirror in the present example. A layer or a layer system 115 (which, in the case of a mirror, for instance, can include e.g. a reflection layer system composed of molybdenum and silicon layers) is applied on the fully polished surface 114 of the workpiece 140, also referred to as substrate. The substrate 140 is machined using a suitable material-removing (optionally also material-adding) tool, which is referred to for short as "tool" in the present text. Not only the substrate 140 but also the layer 115 itself can be machined in this way. The workpiece 140 can be produced e.g. from silicon (Si) or quartz glass doped with titanium dioxide (TiO2), with examples of materials that are usable being those sold under the trade names ULE (by Corning Inc.) or Zerodur (by Schott AG).

Figure 8:
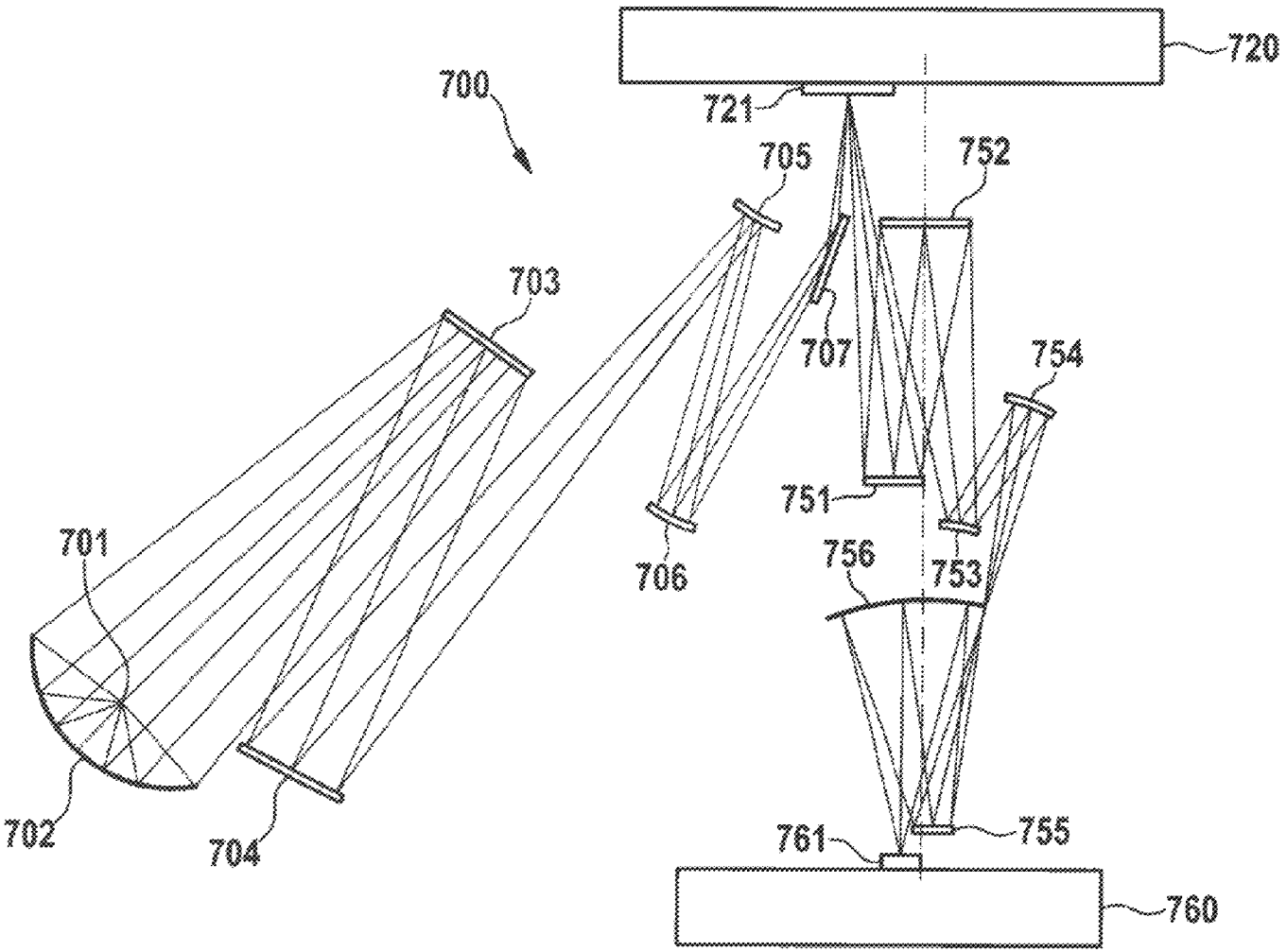
FIG. 8 shows a schematic illustration of a construction of a microlithographic projection exposure apparatus designed for operation in the EUV.

FIG. 8 shows a schematic illustration of a construction of a microlithographic projection exposure apparatus designed for operation in the EUV, wherein the present disclosure can be used in the production of an arbitrary optical element of the projection exposure apparatus. However, the disclosure is not restricted to realization in the production of optical elements for operation in the EUV, but rather is also realizable in the production of optical elements (including transmissive elements such as e.g. lens elements) for other operating wavelengths (e.g. in the DUV range or at wavelengths of less than 250 nm).

In accordance with FIG. 8, an illumination device in a projection exposure apparatus 700 designed for EUV includes a field facet mirror 703 and a pupil facet mirror 704. The light from a light source unit including a plasma light source 701 and a collector mirror 702 is directed onto the field facet mirror 703. A first telescope mirror 705 and a second telescope mirror 706 are arranged in the light path downstream of the pupil facet mirror 704. A deflection mirror 707 is arranged downstream in the light path, the deflection mirror directing the radiation that is incident thereon onto an object field in the object plane of a projection lens including six mirrors 751-756. At the location of the object field, a reflective structure-bearing mask 721 is arranged on a mask stage 720, the mask being imaged with the aid of the projection lens into an image plane in which a substrate 761 coated with a light-sensitive layer (photoresist) is situated on a wafer stage 760.

Figure 9:
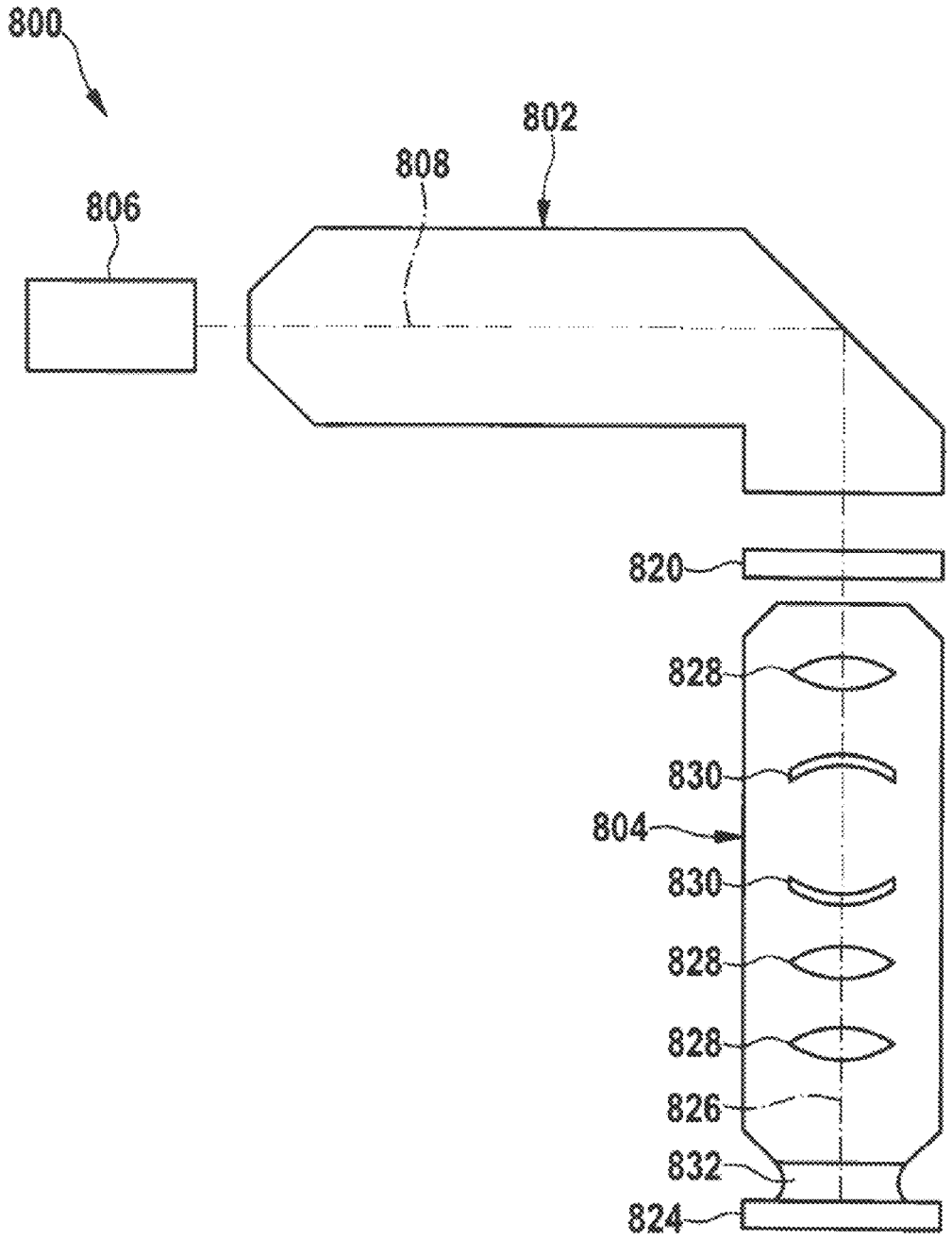
FIG. 9 shows a schematic illustration of a construction of a microlithographic projection exposure apparatus designed for operation in the DUV.

FIG. 9 shows a schematic view of a DUV lithography apparatus 800, which includes a beam shaping and illumination system 802 and a projection system 804. In this case, DUV stands for "deep ultraviolet" and denotes a wavelength of the working light of between 30 and 250 nm.

The DUV lithography apparatus 800 includes a DUV light source 806. By way of example, an ArF excimer laser that emits radiation 808 in the DUV range at 193 nm, for example, can be provided as the DUV light source 806.

The beam shaping and illumination system 802 illustrated in FIG. 9 guides the DUV radiation 808 onto a photomask 820. The photomask 820 is embodied as a transmissive optical element and can be arranged outside the systems 802, 804. The photomask 820 has a structure which is imaged onto a wafer 824 or the like in a reduced fashion via the projection system 804.

The projection system 804 has a plurality of lens elements 828 and/or mirrors 830 for imaging the photomask 820 onto the wafer 824. In this case, individual lens elements 828 and/or mirrors 830 of the projection system 804 can be arranged symmetrically in relation to the optical axis 826 of the projection system 804. It should be noted that the number of lens elements and mirrors of the DUV lithography apparatus 800 is not restricted to the number illustrated. More or fewer lens elements and/or mirrors can also be provided. Furthermore, the mirrors are generally curved on their front side for beam shaping.

An air gap between the last lens element 828 and the wafer 824 can be replaced by a liquid medium 832 which has a refractive index of >1. The liquid medium 832 can be high-purity water, for example. Such a construction is also referred to as immersion lithography and has an increased photolithographic resolution.

Even though the disclosure has been described on the basis of specific embodiments, to numerous variations and alternative embodiments will be apparent to the person skilled in the art, for example through combination and/or exchange of features of individual embodiments. Accordingly, it goes without saying for the person skilled in the art that such variations and alternative embodiments are also encompassed by the present disclosure, and the scope of the disclosure is restricted only within the meaning of the appended patent claims and the equivalents thereof.

LIST OF REFERENCE SIGNS

100 Rotary tool
102 Polishing agent supply
104 Axis of rotation
106 Tool carrier with polishing pad in the case of the rotary tool
110 Excursion section with the use of a rotary tool
112 Effective area of the rotary tool, or area on which material is removed, when the tool is not guided over the workpiece
114 surface to be polished (e.g. freeform surface) of the workpiece
115 Reflection layer system (e.g. MoSi layers)
120 Illustration of the polishing method with zonal machining by the rotary tool
130 Polishing pad
132 Polishing agent
136 Tool carrier
140 Workpiece=(mirror) substrate
150 optical element=(mirror) substrate 140 with reflection layer system 115 or lens element
200 Eccentric tool
202 Polishing agent supply
204 Axis of rotation
206 Tool carrier with polishing pad in the case of the eccentric tool
210 Excursion section with the use of an eccentric tool
212 Effective area of the eccentric tool, or area on which material is removed, when the tool is not guided over the workpiece
214 surface to be polished (e.g. freeform surface) of the workpiece
220 Illustration of the polishing method with zonal machining by eccentric tool
311 Removal rate over time with the use of a rotary tool having a polishing pad without structuring
312 Polishing pad without structuring
314 Direction of rotation
316 dried-on polishing agent residues on the polishing pad
317 first opening angle of the spiral arms
318 Axis of rotation=center of the polishing pad
319 second opening angle of the spiral arms
320 primary structuring in a spiral shape
321 Removal rate with the use of a rotary tool having a polishing pad having a structuring in a spiral shape
322 Polishing pad having a structuring in a spiral shape
331 Removal rate with the use of a rotary tool having a polishing pad having a primary structuring in a spiral shape and a secondary structuring in the form of rotationally symmetrical channels
332 Polishing pad having a primary structuring in a spiral shape and a secondary structuring in the form of rotationally symmetrical channels
334 rotationally symmetrical channels
412 Polishing pad having a primary structuring in a spiral shape and a secondary structuring in the form of asymmetrically arranged channels
414 Direction of rotation
418 Axis of rotation
420 primary structuring in a spiral shape
422 secondary structuring in the form of asymmetrically arranged channels
510 Removal rate with the use of an eccentric tool having a polishing pad without structuring
511 Removal rate with the use of an eccentric tool having a polishing pad having regular and symmetrical structuring (checkered pattern)
512 Polishing pad having regular and symmetrical structuring (checkered pattern)
521 Structuring
522 Channels
524 Ridges
d1 Width of the ridges
d2 Width of the channels
d3 Depth of the channels
610, 620, 630, 640, 650 are the partial steps of the method for machining a workpiece in the production of an optical element
700 EUV projection exposure apparatus
701 to 760 parts of the EUV projection exposure apparatus
800 DUV projection exposure apparatus
802 to 832 parts of the DUV projection exposure apparatus

What is claimed is:

1. A method, comprising:

using a polishing tool to move a structured polishing pad over a surface of a workpiece to remove material from the workpiece, thereby zonally polishing the workpiece to provide a polished surface of the workpiece;

after zonally polishing the workpiece, smoothing the polished surface of the workpiece to provide a smoothed surface of the workpiece; and disposing a reflecting layer on the smoothed surface of the workpiece.

2. The method of claim 1, further comprising rotating the structured polishing pad over the surface of the workpiece.

3. The method of claim 2, further comprising eccentrically moving the structured polishing pad over the surface of the workpiece.

4. The method of claim 1, further comprising eccentrically moving the structured polishing pad over the surface of the workpiece.

5. The method of claim 1, wherein disposing the reflecting layer on the smoothed surface of the workpiece provides an optical element which comprises the reflective surface supported by the workpiece.

6. The method of claim 1, further comprising, before zonally polishing the workpiece, zonally lapping the workpiece.

7. The method of claim 6, wherein zonal lapping comprises using an effective area of the tool that is less than 20% of an area of the surface of the workpiece that is to be processed.

8. The method of claim 1, wherein zonal polishing comprises using an effective area of the tool that is less than 20% of an area of the surface of the workpiece that is to be processed.

9. The method of claim 1, wherein a rate of material removal from the workpiece is approximately constant.

10. The method of claim 1, wherein the reflecting layer is configured to reflect EUV radiation.

11. The method of claim 1, wherein the reflecting layer is configured to reflect UV light.

12. The method of claim 1, wherein the reflecting layer comprises a plurality of layers of different materials.

13. The method of claim 1, wherein the polishing pad comprises a primary structure and a secondary structure, the primary structure comprises a spiral shape comprising a plurality of spiral arms, and the secondary structure comprises rotationally asymmetrical channels.

14. The method of claim 1, further comprising, before using the polishing tool:

selecting an intended movement of the polishing tool over the surface of the workpiece; and selecting the polishing tool based on the intended movement of the polishing pad over the workpiece.

15. The method of claim 1, wherein the polishing tool is moved periodically moved over the surface of the workpiece.

* * * * *